United States Patent [19]

Kataishi et al.

[11] Patent Number: 4,659,527

[45] Date of Patent: Apr. 21, 1987

[54] METHOD OF MOLDING A LIGHT-WEIGHT, CELLULAR CONCRETE PANEL HAVING A WINDOW OR CERAMIC PLATE EMBEDDED THEREIN

[75] Inventors: Takao Kataishi, Kagamihara; Syonin Suenaga, Kohnan, both of Japan

[73] Assignee: Misawa Homes Company Limited, Tokyo, Japan

[21] Appl. No.: 827,679

[22] Filed: Feb. 10, 1986

Related U.S. Application Data

[63] Continuation of Ser. No. 581,173, Feb. 17, 1984, abandoned.

[30] Foreign Application Priority Data

Feb. 17, 1983 [JP] Japan ..... 58-25131
Jun. 15, 1983 [JP] Japan ..... 58-107445

[51] Int. Cl.[4] ..... B28B 1/50; B28B 23/00; B28B 23/22; E04B 2/00

[52] U.S. Cl. ..... 264/46.4; 52/308; 52/397; 264/42; 264/256; 264/259; 264/333

[58] Field of Search ..... 264/256, 259, 333, 42, 264/46.4; 52/308, 397

[56] References Cited

U.S. PATENT DOCUMENTS 2,522,116 9/1950 Hayes ..... 264/42
3,643,910 2/1972 Heifetz ..... 264/32 X
4,357,289 11/1982 Jakobsson ..... 264/42

FOREIGN PATENT DOCUMENTS 1126825 12/1956 France ..... 264/256
47-15154 5/1972 Japan .
51-11858 4/1976 Japan .
51-11859 4/1976 Japan .

*Primary Examiner*—Philip Anderson
*Attorney, Agent, or Firm*—Parkhurst & Oliff

[57] ABSTRACT

The process for making and the structure of a panel of light-weight, cellular concrete having at least one opening, and capable of holding at least one pane of glass or sheet of ceramic in said opening without a mounting frame.

16 Claims, 8 Drawing Figures

METHOD OF MOLDING A LIGHT-WEIGHT, CELLULAR CONCRETE PANEL HAVING A WINDOW OR CERAMIC PLATE EMBEDDED THEREIN

BACKGROUND OF THE INVENTION

This is a continuation of application Ser. No. 581,173 filed Feb. 17, 1984, now abandoned.

This invention concerns a method of making and the structural features of a concrete panel in which a glass member or a ceramic member is mounted without a mounting frame.

In conventional concrete panels for use in buildings, houses or other architectural structures, fixed windows required mounting frames, such as sashes or gaskets, when mounting a glass member in an opening in a concrete panel.

Heretofore, glass or ceramic members have not been mounted without mounting frames because when such members were embedded in uncured concrete panels without mounting frames, and then the panels were cured, the concrete and glass or ceramic members were subjected to differential expansion resulting in the glass or ceramic member being cracked or broken. The differences in expansion and shrinkage coefficients for concrete and glass and ceramics have traditionally caused builders to insert glass and ceramics into concrete panels after curing the concrete.

SUMMARY OF THE INVENTION

In view of the foregoing, it is an object of this invention to provide a light-weight, cellular concrete panel wherein the entire panel with a glass or ceramic member therein is constructed prior to curing the concrete.

Another object of the present invention is to use a light-weight, cellular concrete in the panel. The light-weight, cellular concrete should have a lower resistance to compression strength than the glass or ceramic member integrally fitted with the concrete. The light-weight, cellular concrete has a cellular foam structure that will deform about the edges of the glass or ceramic member during differential expansion and thereby decrease the amount of stress exerted on the glass or ceramic member.

A further object of the instant invention is to provide a concrete panel with a fixed window or pane, which panel also has an acceptable surface design.

Yet another object of the present invention is to provide a building material and structure that reduces the number of components needed to build a house.

Still another object of the instant invention is to provide a panel of light-weight, cellular concrete wherein the outer circumference of a sheet of glass or ceramic material to be mounted in the cellular concrete is prevented from directly contacting the light-weight, cellular concrete such that the sheet may slide smoothly relative to the concrete in a stress-relieving manner, without regard to the direction that stress is exerted on the glass or ceramic member.

These objects and others will become apparent with reference to the attached drawings and the appended claims.

DESCRIPTION OF THE PREFERRED EMBODIMENTS

Figure 1:
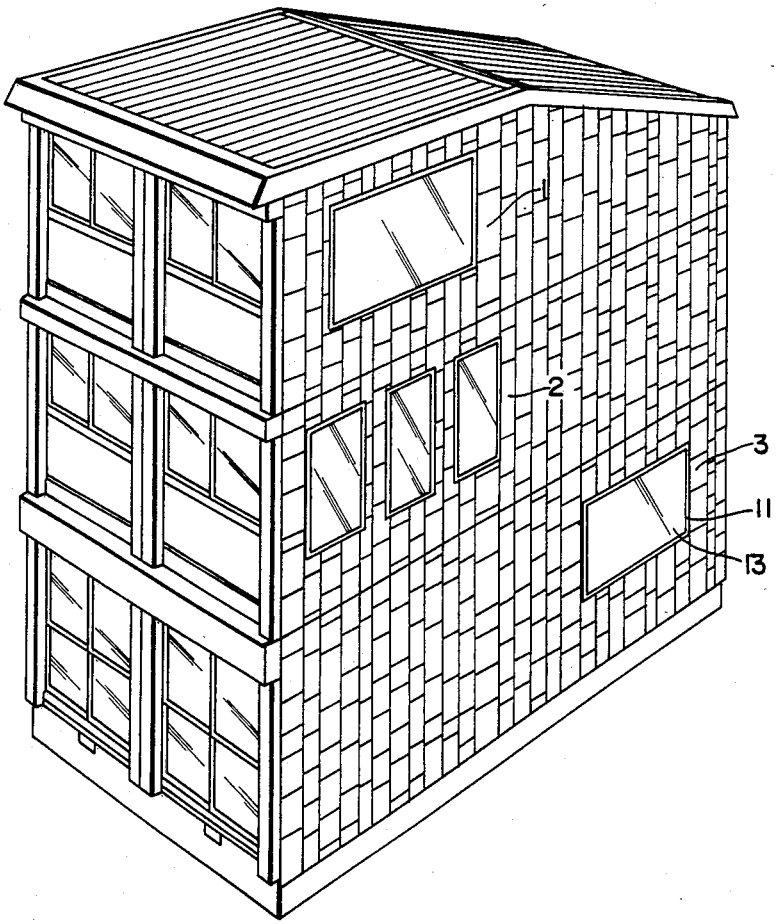
FIG. 1 is a perspective view of the exterior side of a house wherein the side of the house is constructed from three light-weight, cellular concrete panels prepared according to this invention.

FIG. 1 is a perspective view of the exterior side of a house constructed from three light-weight, cellular concrete panels 1, 2 and 3. The light-weight, cellular panels 1 and 3 each have a single opening 11. A glass or ceramic member 13 is fitted within each opening 11. Panel 2 has a plurality of openings 11, with each opening 11 containing a glass or ceramic member 13. There is no particular limit to the number of openings formed in each light-weight, cellular concrete panel. For the sake of convenience, the following description is directed to embodiments of the invention having a single opening 11 with a single glass or ceramic member 13 fitted into the single opening 11.

Figure 2:
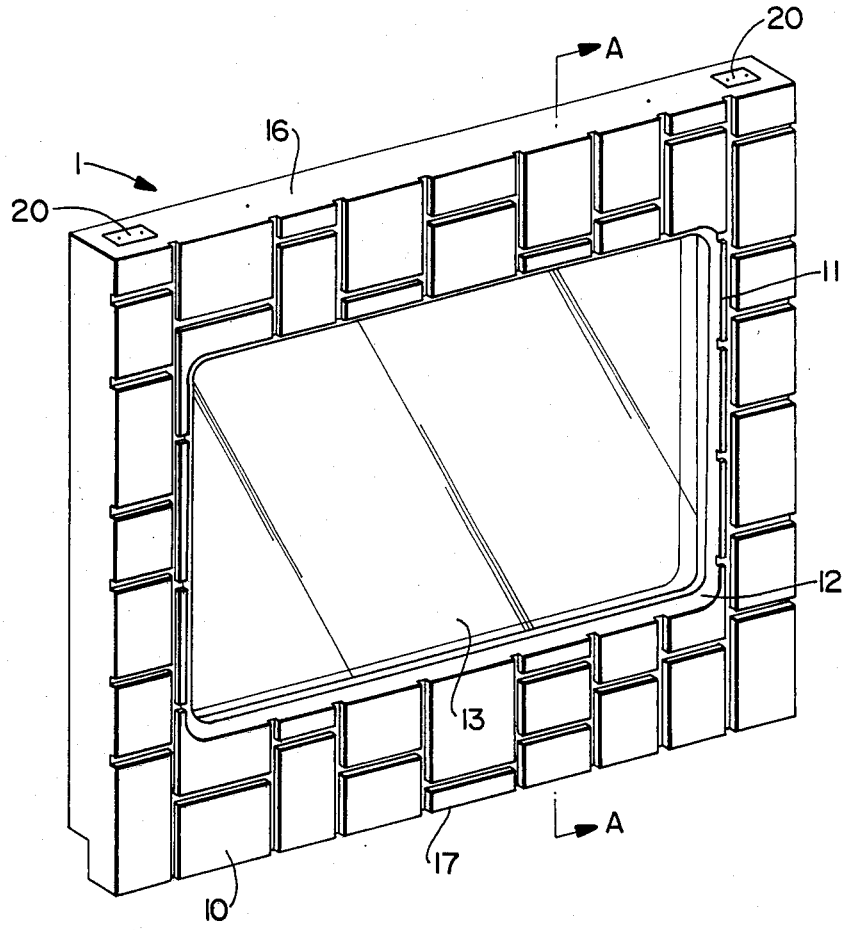
FIG. 2 is a perspective view of a light-weight, cellular concrete panel according to this invention.

FIG. 2 is a perspective view of a preferred embodiment of a light-weight, cellular concrete panel according to this invention. In this embodiment, panel 1 has an opening 11. Opening 11 has a rectangular shape, and is disposed in the central area of a light-weight, cellular concrete substrate 10 (hereinafter simply referred to as substrate 10). Opening 11 may have a variety of shapes besides rectangular, i.e., it may have a curved or polygonal shape such as a circular shape or semi-circular shape. Opening 11 has a glass or ceramic member 13 mounted on an inner circumferential edge 12 of the opening 11 forming a completed panel 1. The panel 1 has an upper end 16 and a lower end 17. In each end 16 and 17 may be embedded mounting brackets 20. These brackets 20 have means for connecting together adjacent light-weight, cellular panels while erecting a house. In this embodiment, panel 1 has a geometrical design applied to one surface of the panel in order to provide an aesthetically pleasing exterior appearance of the house.

Figure 3:
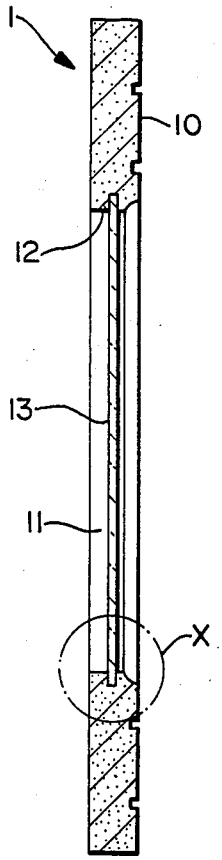
FIG. 3 is a cross-sectional view taken along line A—A of FIG. 2.

FIG. 3 is a view of the panel illustrated in FIG. 2 taken in cross-section along line A—A of FIG. 2. In FIG. 3, glass or ceramic member 13 is embedded in substrate 10 at opening 11. Glass or ceramic member 13 has an outer circumference fitted to the inner circumferential edge 12 of the opening 11 in substrate 10. Circled portion X of FIG. 3 is the position where the glass or ceramic member 13 is embedded in the substrate 10.

Figure 4:
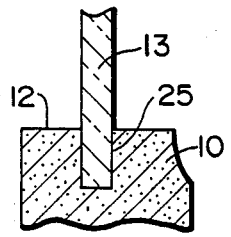
FIG. 4 is an enlarged view showing one embodiment of the portion X of FIG. 3.
Figure 5:
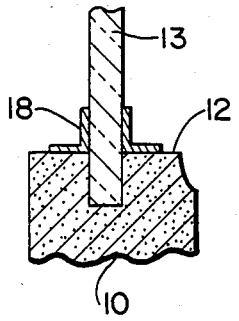
FIG. 5 is an enlarged view of a second embodiment of the portion X of FIG. 3.
Figure 6:
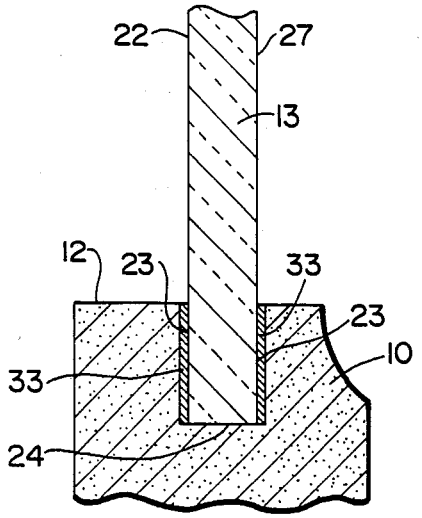
FIG. 6 is an enlarged view of a third embodiment of the portion X of FIG. 3.

FIGS. 4, 5 and 6 show three different embodiments of the present invention. These three figures are enlarged views of the portion denoted by X in FIG. 3.

Figure 8:
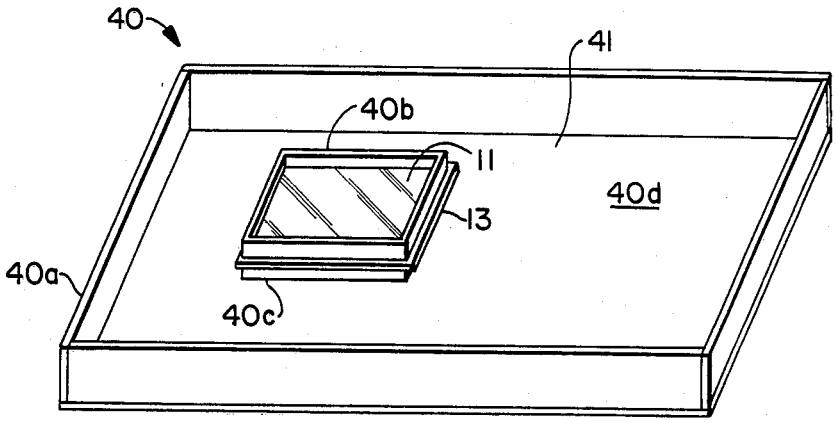
FIG. 8 is a perspective view of a mold suitable for use with the present invention, with a glass panel positioned within a cavity therein.

FIG. 4 illustrates glass member 13 as directly interfitted in a slot 25 within the inner circumferential edge 12 of the opening 11 in the substrate 10. In producing a panel according to this embodiment, glass or ceramic member 13 is disposed within a mold 40 as best shown in FIG. 8. The specific mold construction is within the capability of those skilled in the art, and, as schematically depicted in FIG. 8, may consist of walls 40*a*, bottom 40*d*, and portions 40*b* and 40*c* for suspending the glass or ceramic member in position until the concrete is cured. Next, uncured, light-weight, cellular concrete is cast into the mold cavity 41 around the glass or ceramic member 13. Finally, the light-weight, cellular concrete is cured, forming substrate 10. Substrate 10 has a resistance to compression lower than that of the glass or ceramic member 13. If the glass or ceramic member 13 and the concrete are subjected to heating, e.g., during autoclave curing, the differential thermal expansion between the glass or ceramic member and the concrete can be accomodated by the concrete. That is, the concrete substrate absorbs the expansion. The concrete substrate 10 absorbs the stress by deforming or compressing in the area around the glass or ceramic member 13. Deformation of the concrete occurs when the cells of the light-weight, cellular concrete substrate 10 are crushed by the expansion. The cellular texture of the concrete can be compressed and crushed, irrespective of the difference in the expansion coefficients between the substrate 10 and glass or ceramic member 13. By undergoing deformation, the concrete does not crack or break the glass or ceramic member 13 during differential expansion irrespective of the direction of the stress.

FIG. 5 illustrates a second embodiment of the present invention. In this embodiment, the glass or ceramic member 13 is embedded in the substrate 10, and a sealing member 18, preferably of a rubber-like silicone material, a synthetic resin material, or a similar substance, is deposited on the inner circumferential edge 12 of the opening 11 after curing of the panel. This sealing member 18 prevents any undesirable intrusion of water or condensation through the joint between the glass or ceramic member and the substrate should any gap occur at the mounting position between the glass or ceramic member 13 and the substrate 10. The sealing member 18 can fill gaps resulting from heat expansion between the glass or ceramic member 13 and the substrate 10 during curing of the light-weight, cellular cement.

FIG. 6 illustrates a third embodiment of the enlarged cross-section portion X of FIG. 3. In FIG. 6, glass or ceramic member 13 is fitted to the inner circumferential edge 12 of an opening 11 with a spacer material 33 disposed between the glass or ceramic member 13 and the substrate. Spacer 33 can be formed, for instance, of a metal film or a synthetic resin film and disposed between the outer circumferential periphery 23 of the glass or ceramic member 13 and the substrate 10. Spacer 33 can be disposed on a face 22 of the glass or ceramic member 13 and/or on a face 27 of the glass or ceramic member 13.

In this embodiment, the outer circumferential periphery 23 of the glass or ceramic member 13 does not directly contact the light-weight, cellular concrete substrate 10 but is separated from substrate 10 by spacer 33.

Thus, where expansion occurs in the concrete, for instance, due to a condensation reaction during an autoclave-curing operation of the concrete, the resulting stress and distortion of the substrate 10 can be absorbed by the spacer 33. Spacer 33, when made from a synthetic resin film, can be diffused or burnt out during the high temperature autoclave operation. Thus, spacer 33 can cause a gap to form between the light-weight, cellular substrate 10 and the glass or ceramic member 13. This gap properly spaces apart the light-weight, cellular substrate 10 from the glass or ceramic member 13 without placing the member 13 directly in contact with the substrate, thereby ensuring a reliable sliding movement between the glass or ceramic member 13 and the substrate 10. This sliding movement occurs without cracking, breaking or scraping of the glass or ceramic member 13. Spacer 33 may be prepared by adhering a synthetic resin film (e.g., an adhesive tape) to a circumferential periphery of the glass or ceramic member 13. If desired, spacer 33 may be wound around the outer circumferential edge 24 of the glass pane 13. Alternatively, the spacer 33 may be formed by coating the outer circumferential periphery of the glass or ceramic member 13 with a resin solution. The material and the structure for spacer 33 should not be fused to the concrete substrate 10.

Another kind of spacer 33 may be prepared by adhering a metal membrane onto the glass or ceramic member 13 or by applying a metal material onto the glass or ceramic member 13 by vacuum deposition.

Figure 7:
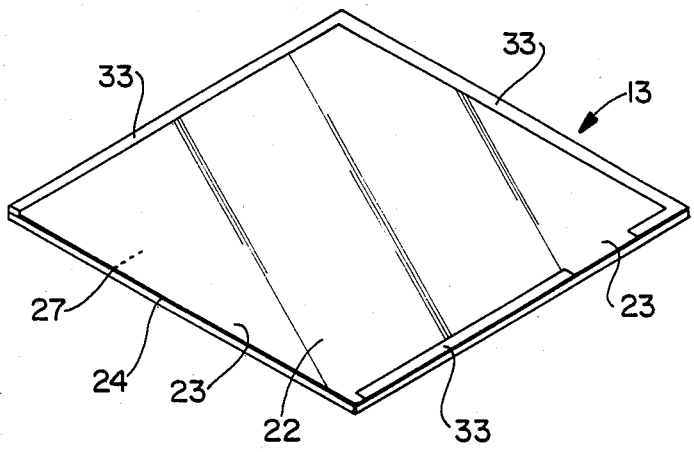
FIG. 7 is a partially cut-away view of a glass or ceramic member to be mounted in a light-weight, cellular concrete panel.

FIG. 7 is a partial perspective view of the glass or ceramic member 13 to be fitted into opening 11 of the substrate 10. In FIG. 7, the glass or ceramic member 13, preferably formed from float glass or a similar substance, has attached a spacer 33, preferably formed from a metal film or a synthetic resin film. Spacer 33 is preferably disposed on the outer circumferential periphery of the member 13. Member 13 has two faces, 27 and 22. The outer circumferential part 23 of the member 13 interfits with the light-weight, cellular concrete prior to curing of the concrete into a panel.

Spacer 33 has a width approximately the same as the engaging depth of the outer circumferential part 23 of member 13 which is interfitted with the light-weight, cellular concrete.

To fabricate the light-weight, cellular concrete panel, member 13 is arranged within a concrete casing mold 40 (see FIG. 8), and uncured light-weight, cellular concrete is cast into the mold cavity 41. After elapse of a predetermined amount of time, the concrete is cured and the mold released, forming a light-weight, cellular panel 1 with glass or ceramic member 13 embedded therein.

While the instant invention has been described with reference to embodiments which comprise a single glass or ceramic member 13 mounted in opening 11, the light-weight, cellular concrete panel can also comprise a plurality of glass or ceramic members 13 with the members 13 disposed side by side along the thickness of the panel in one opening 11.

The instant invention provides remarkable technical and economic advantages by forming a panel having a glass or ceramic member integral with light-weight, cellular concrete having a pleasing exterior design.

What is claimed is:

1. A process for preparing a concrete panel for use in a building, comprising:

providing a mold with a mold cavity for molding a concrete panel, the concrete panel having at least one opening therein;

inserting at least one glass member, without a frame, into the mold cavity at the location of said concrete panel opening such that the edges of said glass member extend into the mold cavity of said mold;

casting curable light-weight cellular concrete having a substantially cellular foam structure in said mold to form a concrete panel having the edges of said at least one glass member embedded therein;

autoclave-curing said concrete panel of curable concrete with the edges of said glass member embedded therein;

wherein said concrete is selected to have a resistance to compression lower than that of said glass member due to the compressibility of cells of said concrete adjacent said glass member, such that, upon curing, said concrete around said edges of said glass member will deform to allow for differential expansion of said glass member and said concrete without substantial damage to said glass member.

2. A process as claimed in claim 1, further comprising the step of affixing a sealing member onto adjoining portions of said glass member and said concrete after curing thereof, thereby to seal any gap occurring between said glass member and said concrete.

3. A process as claimed in claim 2, wherein said sealing member comprises a rubber-like silicone material.

4. A process as claimed in claim 1, wherein a thin substantially flat spacer for spacing said glass member from said concrete is disposed on an outer circumferential periphery of said glass member prior to insertion thereof into said concrete panel opening.

5. A process as claimed in claim 4, wherein said spacer comprises a metal film.

6. A process as claimed in claim 4, wherein said spacer comprises a synthetic resin film.

7. A process as claimed in claim 4, wherein said spacer has a width approximately the same as a depth to which the glass member extends into said mold cavity.

8. A process as claimed in claim 4, wherein said spacer is formed by vacuum deposition of a metal material on said outer circumferential edge of said glass member.

9. A process for preparing a concrete panel for use in a building, comprising:

providing a mold with a mold cavity for molding a concrete panel, said concrete panel having at least one opening therein;

inserting at least one ceramic member, without a frame, into the mold cavity at the location of said concrete panel opening such that the edges of said ceramic member extend into the mold cavity of said mold;

casting curable light-weight cellular concrete having a substantially cellular foam structure in said mold to form a concrete panel having the edges of said at least one ceramic member embedded therein;

autoclave-curing said concrete panel of curable concrete with the edges of said ceramic member embedded therein;

wherein said concrete is selected to have a resistance to compression lower than that of said ceramic member due to the compressibility of cells of said concrete adjacent said ceramic member, such that, upon curing, said concrete around said edges of said ceramic member will deform to allow for differential expansion of said ceramic member and said concrete without substantial damage to said ceramic member.

10. A process as claimed in claim 9, further comprising the step of affixing a sealing member onto adjoining portions of said ceramic member and said concrete after curing thereof; thereby to seal any gap between said ceramic member and said concrete.

11. A process as claimed in claim 10, wherein said sealing member comprises a rubber-like silicone material.

12. A process as claimed in claim 9, wherein a thin substantially flat spacer for spacing said ceramic member from said concrete is disposed on an outer circumferential periphery of said ceramic member prior to insertion thereof into said concrete panel opening.

13. A process as claimed in claim 12, wherein said spacer comprises a metal film.

14. A process as claimed in claim 12, wherein said spacer comprises a synthetic resin film.

15. A process as claimed in claim 12, wherein said spacer has a width approximately the same as a depth to which the ceramic member extends into said mold cavity.

16. A process as claimed in claim 12, wherein said spacer is formed by vacuum deposition of a metal material on said outer circumferential edge of said ceramic member.

* * * * *